US008186445B2

(12) United States Patent
Monjure

(10) Patent No.: US 8,186,445 B2
(45) Date of Patent: May 29, 2012

(54) SYSTEM, METHOD AND APPARATUS FOR THERMAL WELLHEAD HAVING HIGH POWER CABLE FOR IN-SITU UPGRADING PROCESSING

(75) Inventor: Noel A. Monjure, Cypress, TX (US)

(73) Assignee: Vetco Gray Inc., Houston, TX (US)

( * ) Notice: Subject to any disclaimer, the term of this patent is extended or adjusted under 35 U.S.C. 154(b) by 144 days.

(21) Appl. No.: 12/428,615

(22) Filed: Apr. 23, 2009

(65) Prior Publication Data

US 2010/0270032 A1 Oct. 28, 2010

(51) Int. Cl.
*E21B 19/00* (2006.01)

(52) U.S. Cl. ..... 166/379; 166/65.1

(58) Field of Classification Search ..... 166/85.1, 166/65.1, 379; 439/191, 194, 195
See application file for complete search history.

(56) References Cited

U.S. PATENT DOCUMENTS

| | | | | |
|---|---|---|---|---|
| 3,437,149 | A * | 4/1969 | Cugini et al. | 166/379 |
| 4,426,124 | A | 1/1984 | Vandevier | |
| 4,627,489 | A * | 12/1986 | Reed | 166/65.1 |
| 4,628,392 | A | 12/1986 | Didier | |
| 4,708,201 | A * | 11/1987 | Reed | 166/65.1 |
| 4,834,174 | A | 5/1989 | Vandevier | |
| 5,180,014 | A * | 1/1993 | Cox | 166/384 |
| 5,289,882 | A * | 3/1994 | Moore | 166/379 |
| 6,494,266 | B2 * | 12/2002 | Bartlett et al. | 166/339 |
| 6,688,386 | B2 * | 2/2004 | Cornelssen et al. | 166/65.1 |
| 7,080,996 | B2 * | 7/2006 | Ostergaard | 439/188 |

OTHER PUBLICATIONS

GE Oil & Gas Home, Subsea Electrical Power Systems, 1997, http://www.gepower.com/businesses.
Vetcogray, Subsea Processing and Power Systems.
Vetcogray, Mecon WM-1, Product Information Sheet.

* cited by examiner

*Primary Examiner* — Shane Bomar
*Assistant Examiner* — Kipp Wallace
(74) *Attorney, Agent, or Firm* — Bracewell & Giuliani LLP

(57) ABSTRACT

A thermal wellhead having a high voltage cable for in-situ upgrading and processing unconventional oil reservoirs is disclosed. An electrical cable has a power umbilical with an electrical heater on a lower end and an electrical connector opposite the heater. An upper portion of the cable has a second electrical connector for connection with the first connector and is connected to a transformer. A well control device is installed at the wellhead and the umbilical is extended through the device in the well. The first connector is landed in the wellhead such that the umbilical extends downward through the well. The well control device is then removed from the wellhead, and the second connector is secured in a tubing bonnet. The bonnet is landed on the wellhead to make electrical connections between the connectors.

16 Claims, 5 Drawing Sheets

SYSTEM, METHOD AND APPARATUS FOR THERMAL WELLHEAD HAVING HIGH POWER CABLE FOR IN-SITU UPGRADING PROCESSING

BACKGROUND OF THE INVENTION

1. Technical Field

The present invention relates in general to the recovery of oil from unconventional reservoirs and, in particular, to an improved system, method and apparatus for a thermal wellhead having a high power or voltage cable for in-situ upgrading and processing unconventional oil reservoirs.

2. Description of the Related Art

The increasing requirement for hydrocarbon processing and boosting in relation to efficient hydrocarbon field development has generated the need for highly reliable power and distribution systems. The growing power requirements to enable efficient and economic boosting of hydrocarbons have demanded significant development in power systems.

For example, the requirements for surface or subsea components are driven by the transmission distance and power needs for each application. Analysis must be undertaken to define and design a complete power distribution system. One type of subsea electrical connection forms a part of a high voltage (HV) termination system and can be used in pressure compensated systems, or as a high pressure barrier to penetrate a pressure vessel. Another example comprises an HV, wet-mateable connector for HV electrical power cables in subsea applications. This connector uses cable termination technology with an in-situ dielectric conditioning system for the connector internals. This design ensures a reliable make-up subsea over a range of performance, such as 12, 24 or 36 kV/500 A. These power connectors provide wet make-up of underwater electrical interfaces, typically between power cables and electrical power consuming equipment. Following mechanical interlocking and sealing of the connector halves, stroking of the connector takes place in a benign environment created by in-situ flushing and conditioning of the di-electricum.

These connectors are large, however, and are not suitable for all types of production applications, particularly those requiring wellheads with smaller diameters. For example, certain types of non-conventional hydrocarbon environments, such as shale beds, require numerous smaller wells to produce hydrocarbons in separate production wells. The shale is typically heated with electrical or microwave heaters using cables that are deployed in the smaller "heater wells" that extend through the shale beds. The oil is collected in the separate production wells that extend parallel to the heater wells. A thermal wellhead is located at the top of each of the heater wells, and is relatively small in diameter. The above-described solutions for HV applications are far too large to be effectively utilized in such operations. Thus, an improved system, method and apparatus for a thermal wellhead having HV requirements for in-situ upgrading and processing of unconventional oil reservoirs would be desirable.

SUMMARY OF THE INVENTION

Embodiments of a system, method, and apparatus for a thermal wellhead having a high power or voltage cable for in-situ upgrading and processing unconventional oil reservoirs are disclosed. Some embodiments may comprise an electrical assembly for or a method of installing a tool in a thermal well having a thermal wellhead.

For example, some embodiments of the method comprise providing an electrical cable having a power umbilical with a tool, such as an electrical heater or electric submersible pump attached thereto. The tool is on a distal end of the umbilical, and a lower electrical connector is on a proximal end of the umbilical. A separate, upper portion of the cable has a distal end with an upper electrical connector, and a proximal end that connects to, e.g., an electrical transformer.

Prior to installation of the cable, a well control device such as a blow out preventer is installed at the wellhead. The lower portion of the cable is extended through the well control device in the well. The lower electrical connector is subsequently landed in the wellhead or in a tubing hanger, such that the umbilical extends downward through the well with the tool at the end. The well control device is then removed from the wellhead, and the upper electrical connector is secured in a tubing bonnet. The tubing bonnet is then landed on the wellhead, making electrical connections between the upper and lower electrical connectors. Electrical connection also is made between the proximal end of the upper portion of the electrical cable and a well site electrical transformer.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

FIGS. 1-6 depict embodiments of a system, method and apparatus for a thermal wellhead having a high power or voltage cable for in-situ upgrading and processing unconventional oil reservoirs. The invention incorporates the electrical connection into a single supporting member under any combination of voltage or amperage that renders the use of traditional offset or angled connections impractical.

Figure 1:
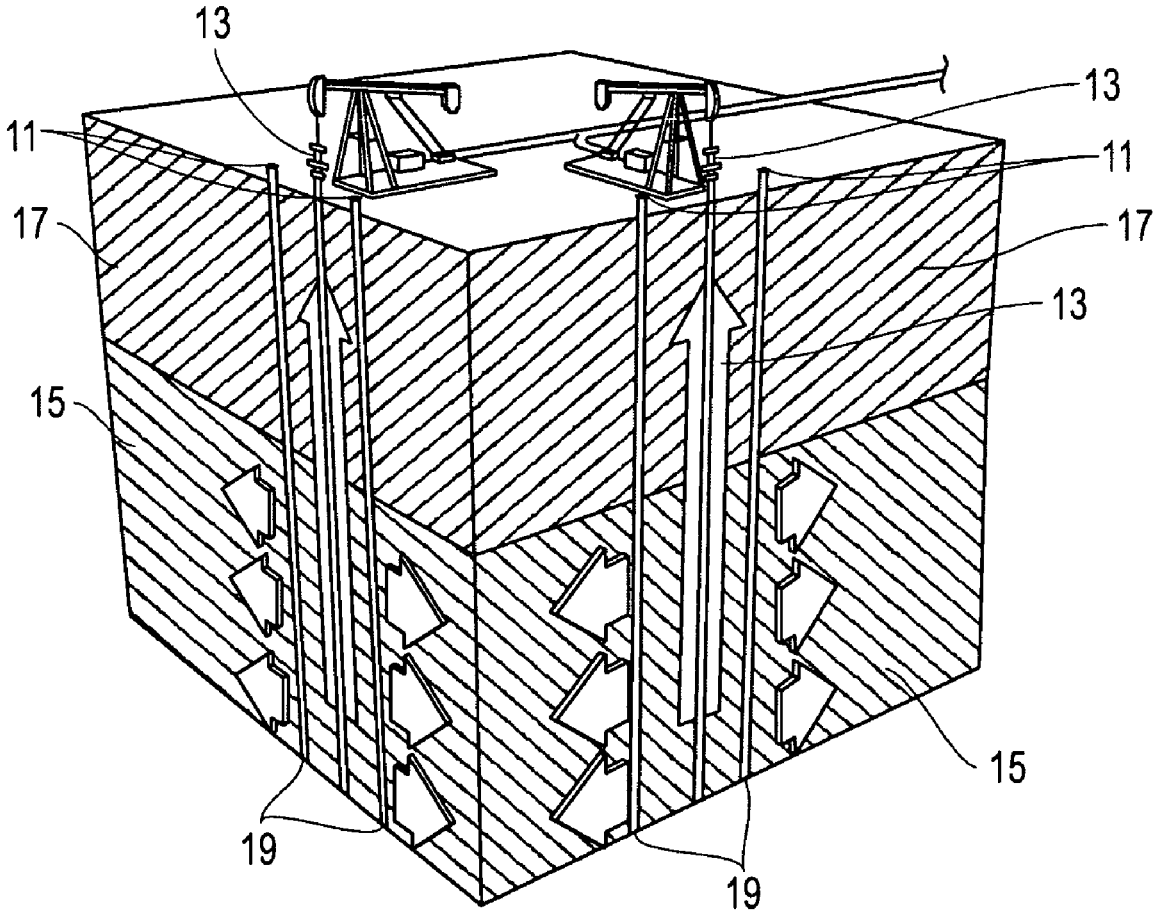
FIG. 1 is a schematic diagram of one embodiment of a hydrocarbon production configuration constructed in accordance with the invention.

For example, FIG. 1 illustrates one type of non-conventional hydrocarbon environment that requires numerous smaller wells 11 to produce hydrocarbons in separate production wells 13. The formation 15 is located below an overburden 17, and is heated with electrical resistance (i.e., "heater") cables 19 that are deployed in the smaller "heater wells" 11 that extend through the formation 15. The oil is collected in the separate production wells 13 that extend parallel to the heater wells. A thermal wellhead is located at the top of each of the heater wells 11, and is relatively small in diameter.

When a well bore is constructed using vertical or horizontal means, one or more wellhead members are attached at the surface or end termination of the wellhead. For certain hydrocarbon reservoirs, high power and/or high voltage is required to deliver either electrical current downhole or heating elements to improve the flow of the hydrocarbons. Traditional means of supplying electrical power use a vertical or horizontal feedthrough mechanism (e.g., a plug) to transfer the power. However, when large amperage or voltage is required, the means for transferring power becomes too large for the wellhead member. The invention facilitates an electrical power transition that is capable of using a conventional or specialized wellhead member that accepts the female or male portion of the power transferring mechanism.

For safety and environmental reasons, a form of well control (e.g., a blowout preventer, or BOP) must be used at the wellhead during installation of the invention, even in low pressure formations. The invention allows the connection to be run through the BOP under normal well control, if necessary, and effect an annular and/or flow bore seal during the final completion of the well. This mechanism also can be incorporated into specialized wellhead members so that the complete assembly can be run through the BOP when desirable. After the BOP and other well control components are removed, the other half of the connection (e.g., male or female connector) is attached and the necessary electrical connections made up. Some embodiments may comprise the capacity to isolate the wellbore from any environmental communication between hydrocarbons in the underground formation and the surface atmosphere, and isolate the wellhead members from the electrical current flowing through the cable.

Figure 2:
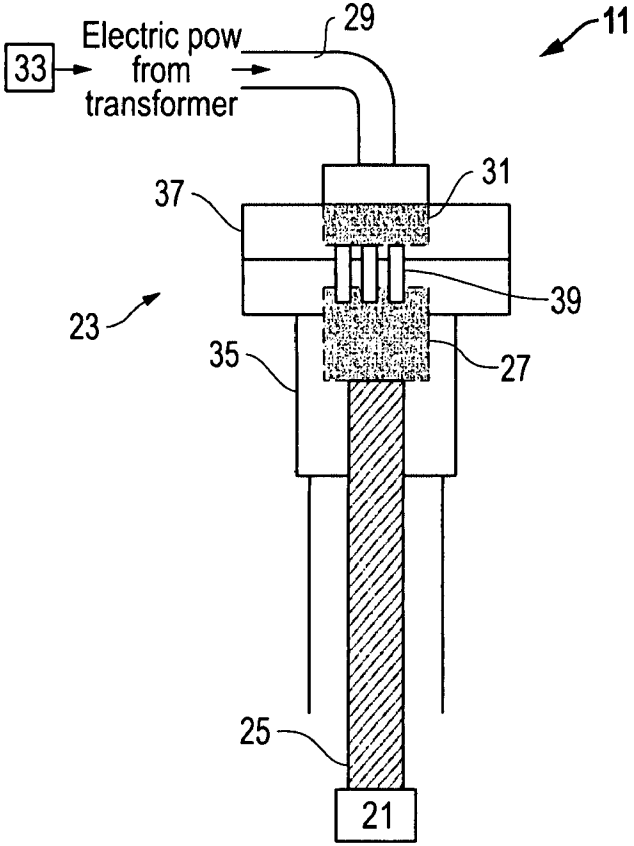

Referring now to FIGS. 2-5, various embodiments of the apparatus and system of the invention are shown. For example, FIG. 2 depicts one type of a well 11 for deploying a tool 21 such as an electrical heater, submersible pump (ESP) or other equipment requiring large amounts of electrical power. The tool 21 may be installed in well 11 and supported at wellhead 23. Some embodiments of an electrical cable have a lower portion or power umbilical 25 on a distal end, and a lower insulated electrical connector 27 on a proximal end. An upper portion 29 of the electrical cable has a distal end with an upper electrical connector 31 and a proximal end adapted to be connected to a well site electrical transformer 33.

A well control device, such as a blow out preventer or BOP, is initially installed at the wellhead 23 and the lower portion 25 of the electrical cable is extended through it into the well. The lower electrical connector 27 is landed axially in the wellhead 23, such as in a tubing head 35 or tubing hanger, such that the lower portion 25 of the electrical cable extends downward through the well, rather than laterally through a side wall of the wellhead. The well control device is then removed from the wellhead 23. The upper electrical connector 31 is secured in an insulated tubing bonnet 37. The bonnet 37 is then landed at the wellhead 23 and electrical connections are made (e.g., via male electrical connectors 32 and female electrical connectors 34 (FIG. 4)) between the upper and lower electrical connectors 31, 27. The proximal end of the upper portion 29 of the electrical cable and the well site electrical transformer 33 also are electrically connected.

Figure 3:
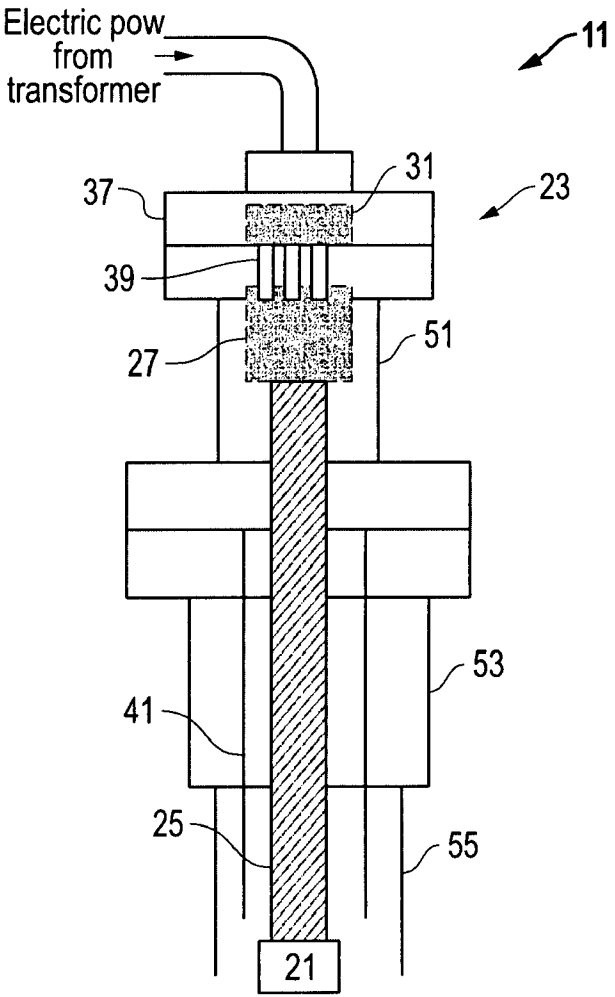
FIGS. 2, 3, 4 and 5 are schematic side views of various embodiments of heater wells having thermal wellheads constructed in accordance with the invention.

In an alternate embodiment, a Christmas tree, such as those known in the art, may be installed at the wellhead 23. This step may occur after the well control device is removed and after the tubing bonnet is landed, such that the Christmas tree is landed on the bonnet. As shown in FIG. 3, production casing 41 or coiled tubing may extend from the wellhead 23 into the well.

Figure 4:
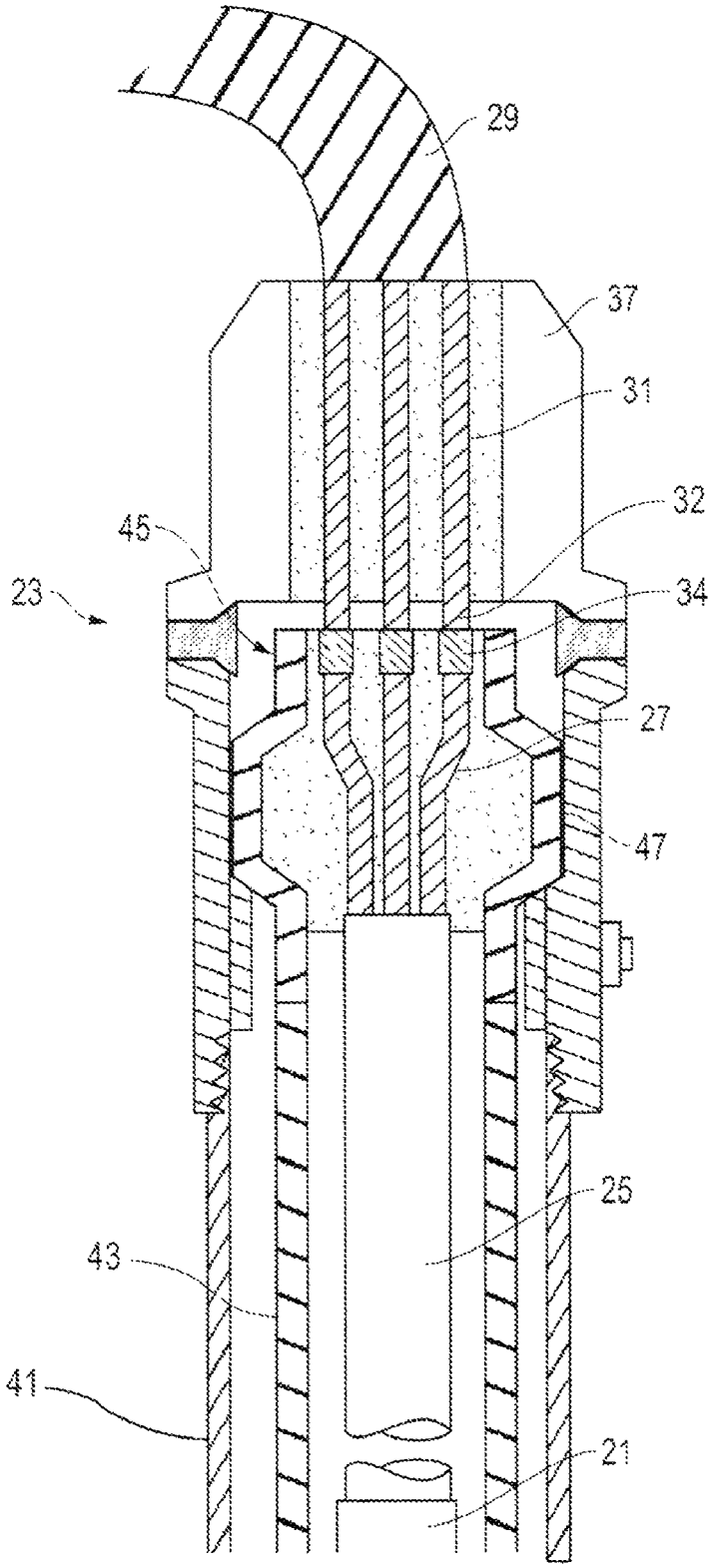

As shown in FIG. 4, a tubing hanger with tubing or liner 43 may be landed in the wellhead and extend through the production casing or coiled tubing 41. The lower portion 25 of the electrical cable extends through these components. The lower portion 25 of the electrical cable may be landed in a power umbilical hanger 45 with a dielectric inner body sealed to conductors in the lower portion 25. Metal-to-metal seals 47 may be provided between the wellhead 23 and tubing 43 or power umbilical hanger 45.

The power umbilical hanger also may be located in the tubing head 35 or tubing spool 51 (FIG. 3). The tubing or casing head 53 supports surface casing 55. The tubing spool 51 may be located between the tubing bonnet 37 and the casing head 53 having production casing 41 and surface casing 55. Accordingly, the tool 21 and electrical connection components described herein may comprise a portion of a system for a pipe-in-pipe downhole heater, a pipe-in-uncased hole, or a unitized power umbilical to transfer power to another downhole device.

Figure 5:
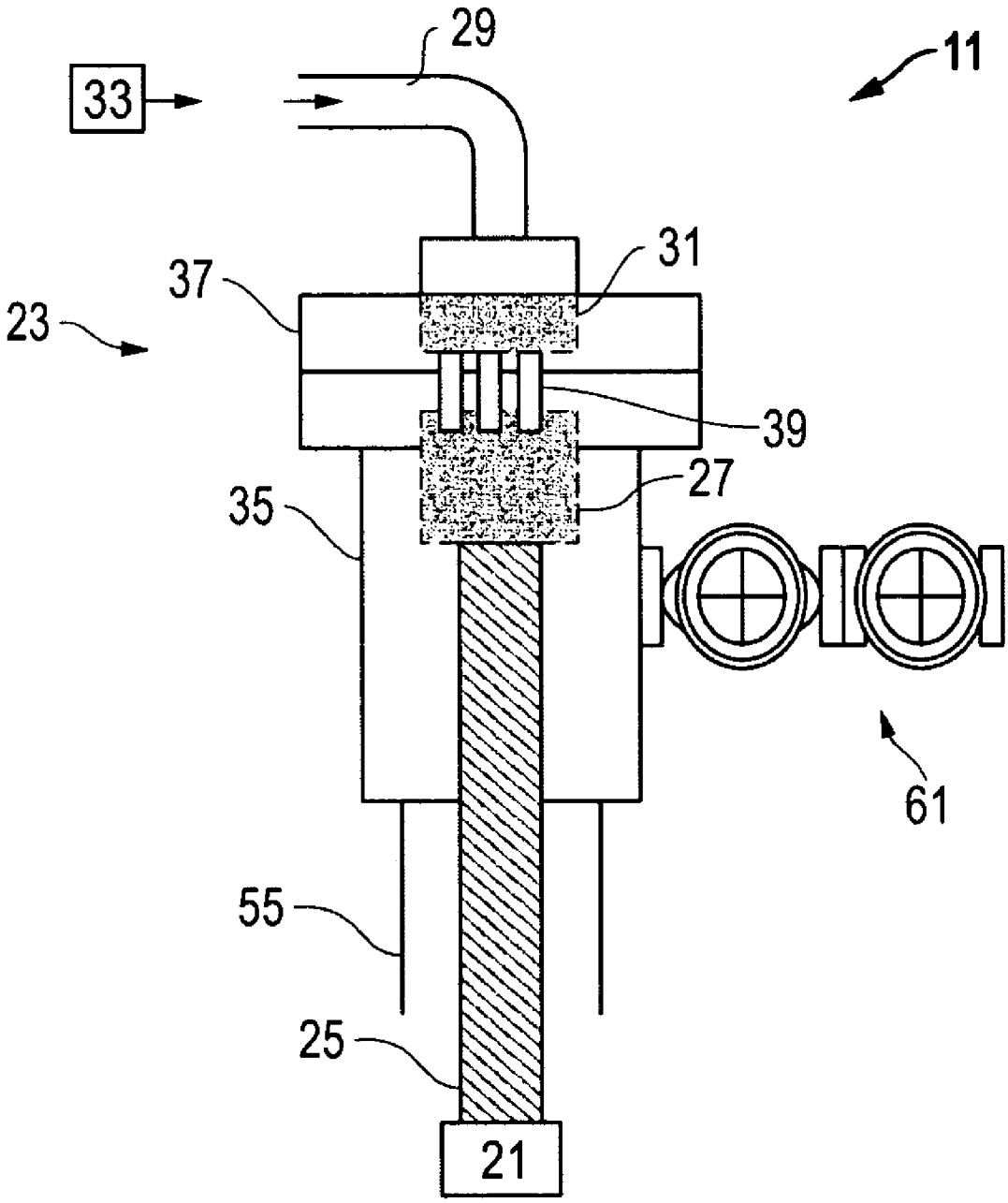

FIG. 5 depicts yet another embodiment that allows pressure or fluid relief from the annulus in the well. Electrical power is supplied from a source 33, such as a transformer, through upper cable 29. Cable 29 makes an integral electrical connection embedded in the modified tubing bonnet 37 and electrically connects via contacts 39 upon flange makeup. The one-piece power umbilical 25 is joined at connector 27 which extends to tubing head 35. Metal seals and a dielectric inner body seal the power cables in the umbilical. The horizontal flow assembly 61 extends horizontally from the tubing head 35 for permitting fluid relief from the well annulus.

Figure 6:
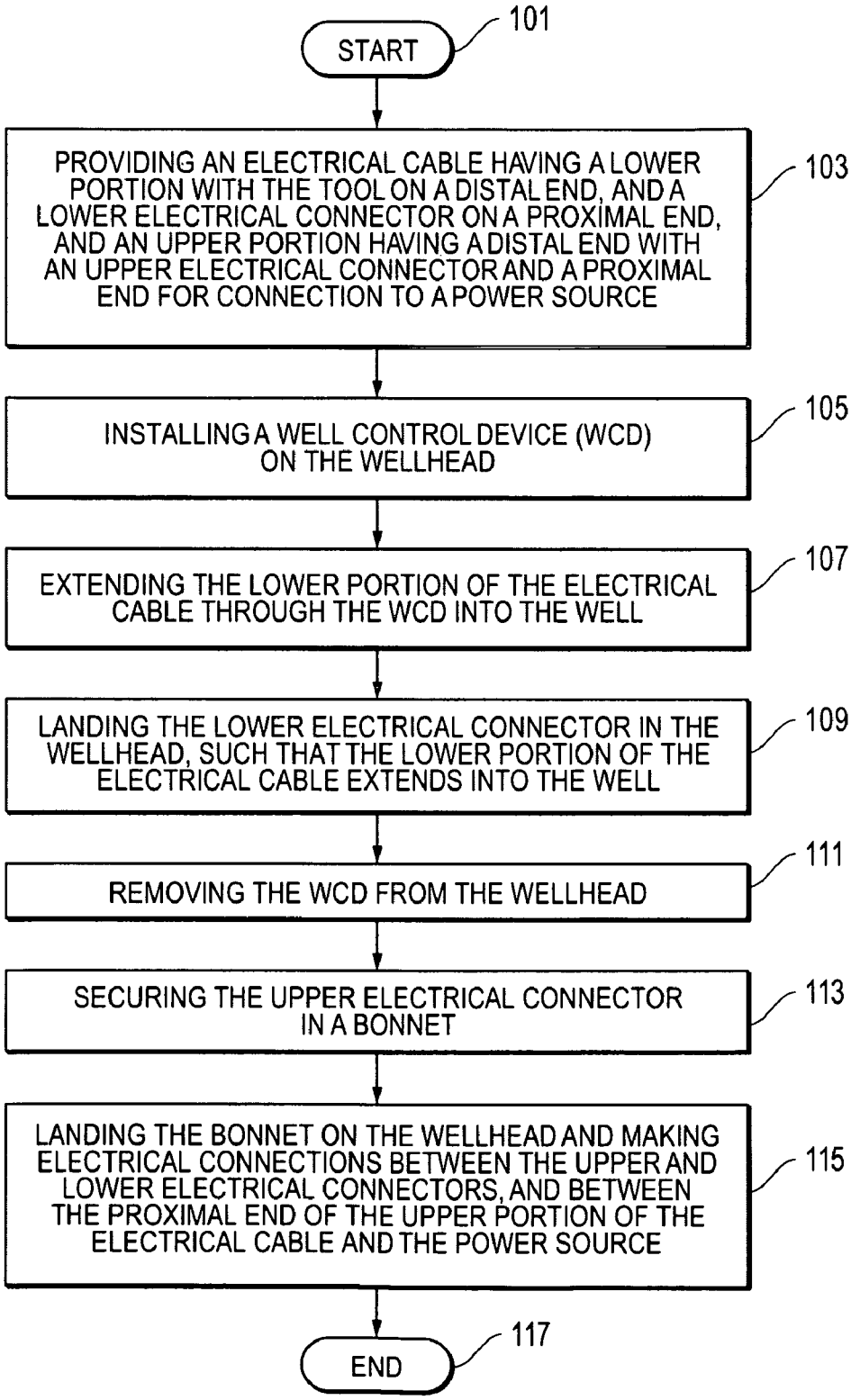
FIG. 6 is a high level flow diagram of one embodiment of a method in accordance with the invention.

FIG. 6 is a high level flow diagram of one embodiment of a method in accordance with the invention. The method begins as illustrated at step 101 and comprises installing a tool in a well having a wellhead. The method proceeds by providing an electrical cable having a lower portion with the tool on a distal end, and a lower electrical connector on a proximal end, and an upper portion having a distal end with an upper electrical connector and a proximal end for connection to a power source (step 103); installing a well control device (WCD) on the wellhead (step 105); extending the lower portion of the electrical cable through the WCD into the well (step 107); landing the lower electrical connector in the wellhead, such that the lower portion of the electrical cable extends into the well (step 109); removing the WCD from the wellhead (step 111); securing the upper electrical connector in a bonnet (step 113); landing the bonnet on the wellhead and making electrical connections between the upper and lower electrical connectors, and between the proximal end of the upper portion of the electrical cable and the power source (step 115), before ending as indicated at 117.

In alternate embodiments, the method may further comprise installing the bonnet on the wellhead, and then installing a Christmas tree on the bonnet. A production casing or coiled tubing may extend from the wellhead into the well, a tubing hanger and tubing are landed in the wellhead and extend through the production casing or coiled tubing, and the lower portion of the electrical cable extends through the tubing hanger and tubing. The lower portion of the electrical cable may be landed in a power umbilical hanger with metal seals and a dielectric inner body sealed to conductors in the lower portion. The power umbilical hanger may be located in one of a tubing head and tubing spool, and the tubing head may support surface casing. The tubing head may have a horizontal flow assembly for permitting horizontal annular flow from the wellhead. The tubing spool may be located between the bonnet and a casing head having production casing and surface casing.

In addition, the tool may comprise one of a pipe-in-pipe downhole heater, a pipe-in-uncased hole, a unitized power umbilical to transfer power to another downhole device, an electrical heater, an electrical submersible pump, an artificial lift device and a downhole injection pump, the WCD may comprise a blow-out preventer, the power source may comprise a well site electrical transformer, the lower electrical connector may be landed in a tubing hanger in the wellhead, and the lower portion of the electrical cable may comprise a power umbilical.

For many operations, the invention also seals the wellbore and transmits the power into the wellbore. In still another embodiment, the connection can be completely assembled and tested prior to field installation in normal cases to eliminate field make-up of the separate electrical components. The umbilical is run into the well and then electrically connected to, e.g., a transformer after the umbilical is installed in the well. This design allows direct connection from locally distributed power sources to be connected safely and quickly. Where applicable, the design also incorporates a method for flushing the electrical sealing chamber(s) with fluids suitable to prevent determination during operation.

While the invention has been shown or described in only some of its forms, it should be apparent to those skilled in the art that it is not so limited, but is susceptible to various changes without departing from the scope of the invention. For example, the invention is well suited for many types of upgrading techniques, such as pipe-in-pipe heaters, minerally-insulated heaters, bare element heaters and the like.

I claim:

1. A system for supplying power to an electrical cable leading to a heater tool disposed in a borehole, comprising:

a wellhead member having a bore with a longitudinal axis and a rim on an upper end, the wellhead member adapted to be installed at an upper end of the borehole with the longitudinal axis centered with the upper end of the borehole;

a hanger that lands concentrically in the bore;

a lower electrical connector mounted in the hanger on the longitudinal axis and having upward-facing contacts, the lower electrical connector adapted to be connected to an upper end of the electrical cable, the upward-facing contacts of the lower electrical connector having upper ends located in the bore of the wellhead member at an elevation below the rim;

a bonnet mounted and sealed to the rim of the wellhead member;

an upper electrical connector mounted concentrically to the bonnet and having downward-facing contacts that mate with the upward-facing contacts, the upper electrical connector adapted to be connected to a power source; and wherein the upper and lower electrical connectors are positioned such that securing the bonnet to the rim of the wellhead member simultaneously causes the downward-facing contacts to engage the upward-facing contacts.

2. The system according to claim 1, further comprising:

a landing element protruding into the bore of the wellhead member; and wherein the hanger lands on and is supported by the landing element.

3. The system according to claim 1, wherein the upper ends of the upward-facing contacts of the lower electrical connector are adjacent an upper end of the hanger.

4. The system according to claim 1, wherein lower ends of the downward-facing contacts of the upper electrical connector are below the bonnet.

5. The system according to claim 1, further comprising:

a relief port extends through a side wall of the wellhead member below the hanger.

6. The system according to claim 1, further comprising:

an annular seal sealing between a periphery of the hanger and a side wall of the bore.

7. A wellhead system for supplying power to a heater tool disposed in a borehole, comprising:

a wellhead member having a bore with a longitudinal axis and a rim on an upper end, the wellhead member adapted to be installed at an upper end of the borehole with the longitudinal axis centered with the upper end of the borehole;

a landing element protruding into the bore from a side wall of the wellhead member;

a hanger landed on the landing element in the bore and sealed to a side wall of the bore;

a lower electrical connector mounted in the hanger on the longitudinal axis and having upward-facing contacts;

a lower electrical cable having an upper end joined to the lower electrical connector and a lower end adapted to be joined to the heater tool;

a bonnet mounted and sealed to the rim of the wellhead member;

an upper electrical connector mounted concentrically to the bonnet and having downward-facing contacts that protrude below the bonnet and simultaneously mate with the upward-facing contacts when the bonnet is mounted and sealed to the rim of the wellhead member; and an upper electrical cable joined to the upper electrical connector and adapted to be connected to a power source.

8. The system according to claim 7, wherein the upward-facing contacts of the lower electrical connector have upper ends adjacent an upper end of the hanger.

9. The system according to claim 7, further comprising:

a relief port extends through a side wall of the wellhead member below the hanger.

10. The system according to claim 7, further comprising:

a support tube secured to a lower side of the hanger, the support tube having a lower end adapted to be secured to the heater tool; and wherein the lower electrical cable extends through the support tube.

11. A method of heating a borehole, comprising:

(a) providing a wellhead member with a bore, an upper rim and a longitudinal axis, and mounting a wellhead member at an upper end of the borehole with the longitudinal axis centered with the upper end of the borehole;

(b) providing an electrical cable with a first electrical connector on an upper end, mounting the electrical connector to a hanger such that electrical contacts of the first electrical connector face upward and have upper ends within the bore of the wellhead member a an elevation below the rim (c) coupling a lower end of the electrical cable to a heater tool, defining a downhole assembly;

(d) lowering the downhole assembly through the wellhead member and into the borehole, then landing the hanger in the wellhead member with the first electrical connector centered on the longitudinal axis;

(e) mounting a second electrical connector to a bonnet such electrical contacts of the second electrical connector face downward; then (f) placing the bonnet on the rim of the wellhead member and simultaneously engaging the electrical contacts of the second electrical connector with the electrical contacts of the first electrical connector; then (g) securing the bonnet to the wellhead member and supplying power to the second electrical connector.

12. The method according to claim 11, wherein:

step (a) comprises providing a landing element protruding into the bore of the wellhead member; and step (c) comprises:

landing the hanger on the landing element and transferring a weight of the electrical cable to the landing element.

13. The method according to claim 11, wherein step (b) comprises:

mounting the first electrical connector such that the upper ends of the electrical contacts of the first electrical connector are adjacent an upper end of the hanger.

14. The method according to claim 11, wherein step (e) comprises:

mounting the second electrical connector such that lower ends of the electrical contacts of the second electrical connector are below the bonnet.

15. The method according to claim 11, further comprising after step (f):

relieving any pressure build up in the borehole through a relief port extending through a side wall of the wellhead member below the hanger.

16. The method according to claim 11, wherein step (c) further comprises:

sealing between a periphery of the hanger and a sidewall of the bore.

* * * * *